US008136922B2

(12) United States Patent
Wu et al.

(10) Patent No.: US 8,136,922 B2
(45) Date of Patent: Mar. 20, 2012

(54) SELF-ASSEMBLY MONOLAYER MODIFIED PRINTHEAD

(75) Inventors: Yiliang Wu, Oakville (CA); Ping Liu, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 348 days.

(21) Appl. No.: 12/551,779

(22) Filed: Sep. 1, 2009

(65) Prior Publication Data

US 2011/0050803 A1 Mar. 3, 2011

(51) Int. Cl.
*B41J 2/14* (2006.01)

(52) U.S. Cl. ..... 347/47

(58) Field of Classification Search ..... 347/44, 347/40, 42, 47, 49, 54, 56, 61, 65, 44.49
See application file for complete search history.

(56) References Cited

U.S. PATENT DOCUMENTS

| | | | |
|---|---|---|---|
| 4,643,948 | A | 2/1987 | Diaz et al. |
| 5,010,356 | A | 4/1991 | Albinson |
| 5,136,310 | A | 8/1992 | Drews |
| 5,598,193 | A | 1/1997 | Halko et al. |
| 5,972,419 | A | 10/1999 | Roitman |
| 6,074,040 | A | 6/2000 | Usui et al. |
| 6,102,521 | A | 8/2000 | Halko et al. |
| 6,325,490 | B1 | 12/2001 | Yang et al. |
| 6,336,697 | B1 | 1/2002 | Fukushima |
| 6,345,881 | B1 | 2/2002 | Yang et al. |
| 6,444,318 | B1 | 9/2002 | Guire et al. |
| 6,547,380 | B2 | 4/2003 | Smith et al. |
| 6,689,473 | B2 | 2/2004 | Guire et al. |
| 6,759,713 | B2 | 7/2004 | Chabinyc et al. |
| 6,808,745 | B2 | 10/2004 | Yang |
| 6,869,821 | B2 | 3/2005 | Knipp et al. |
| 6,872,588 | B2 | 3/2005 | Chabinyc et al. |
| 7,105,375 | B2 | 9/2006 | Wu et al. |
| 7,176,040 | B2 | 2/2007 | Sirringhaus et al. |
| 7,282,735 | B2 | 10/2007 | Wu et al. |
| 7,361,724 | B2 | 4/2008 | Guire et al. |
| 7,553,706 | B2 | 6/2009 | Liu et al. |
| 2007/0275501 | A1 | 11/2007 | Wu et al. |

FOREIGN PATENT DOCUMENTS

| | | | |
|---|---|---|---|
| EP | 0 972 640 | A1 | 1/2000 |
| WO | WO 2007/005857 | A1 | 1/2007 |

OTHER PUBLICATIONS

European Search Report for European Patent Application No. 10173857.3, mailed Feb. 11, 2011.
Office Action in Canadian Patent Application No. 2,713,810 mailed Dec. 9, 2011.

*Primary Examiner* — Kristal Feggins
(74) *Attorney, Agent, or Firm* — Oliff & Berridge, PLC

(57) ABSTRACT

Described herein are printheads for inkjet printing and, more specifically, printheads modified with a self-assembly monolayer (SAM). Also described are processes for making and using the printheads as well as processes for forming patterns and images on a substrate including jetting inkjet inks or jettable materials using a printhead for inkjet printing that has been modified with a self-assembly monolayer.

18 Claims, 7 Drawing Sheets

DESIGNED DOTS ARRAY

PRINTED DOTS ARRAY

SELF-ASSEMBLY MONOLAYER MODIFIED PRINTHEAD

BACKGROUND

This disclosure is generally directed to printheads for inkjet printing and, more specifically, to printheads modified with a self-assembly monolayer (SAM). This disclosure also relates to processes for making and using the printheads as well as processes for forming patterns and images on a substrate using the printheads.

Inkjet printing is known, but the full capabilities of inkjet printing have not yet been explored. Particularly, the field of printed electronics is a realm capable of benefiting from the implementation of inkjet printing technology.

Ink jetting devices are known in the art, and thus extensive description of such devices is not required herein. As described in U.S. Pat. No. 6,547,380 (Smith et al.), which is hereby incorporated herein by reference in its entirety, ink jet printing systems are generally of two types: continuous stream and drop-on-demand.

Inkjet printing of electronics is described in U.S. Pat. No. 5,972,419 (Roitman) as well as in U.S. Pat. No. 7,176,040 (Sirringhaus, et al.), both of which are hereby incorporated by reference herein in their entirety.

U.S. Pat. No. 6,336,697 (Fukushima) discloses a liquid jetting structure with a flow path inside a nozzle that is set to have a degree of affinity for a jetted liquid that changes in the direction of the liquid flow.

U.S. Pat. No. 6,444,318 (Guire et al.), which is hereby incorporated by reference herein in its entirety, discloses a surface coating composition for providing a SAM, in stable form, on a material surface.

U.S. Pat. No. 6,872,588 (Chabinyc et al.) discloses a semiconductor processing method and fabrication methods for large-area arrays of thin film transistors.

U.S. Pat. No. 7,105,375 (Wu et al.) discloses a method of patterning organic semiconductor layers of electronic devices using reverse printing.

U.S. Pat. No. 7,282,735 (Wu et al.), the disclosure of which is totally incorporated herein by reference, discloses a thin film transistor having a fluorocarbon-containing layer which may be a SAM layer.

The deposition of functional materials such as semiconductor, conductor and/or insulating materials using inkjet processes can significantly lower manufacturing costs. However, to manufacture electrical circuits with a sufficient resolution, high printing accuracy of the printed functional materials is very important. Because the functional material formulations, such as semiconductor inks, often contain organic solvents, the inks normally exhibit low surface tension and are therefore sensitive to surface energy variation in the printing surface of the printhead and undesirable ink deposition on the printing surface of the printhead. This sensitivity results in printing issues such as misdirectional deposition of ink drops (or poor accuracy), which results in an inferior product. The present inventors believe that the misdirectional deposition of the ink may be due to accumulation of materials around the printing orifice and/or energy variation of the printhead printing surface, both of which cause spreading or partial coating of the inks around the nozzle area and cause subsequent drop ejections to be misdirected, thereby reducing accuracy and product quality.

While known compositions and processes are suitable for creating printed products, such as marks (words, images and the like) on paper using inkjet printing techniques, due to the sensitivity limitation of human eyes, these conventional images can tolerate an accuracy variability (the difference between the printed product and the original pattern design, or "offset") of about 40 μm from the intended print target. However, for printed electronic applications, higher printing accuracy is required. Printed electronic applications require an accuracy variability of below about 10 μm, such as below about 5 μm. Therefore, a need remains for improvements in ink printing systems, such as improvement in jetting accuracy. One challenge is related to energy variations on the printhead surface and ink accumulation on the printhead surface and around the printing orifice. The energy variations may cause misdirectional deposition of functional ink, resulting in poor jetting accuracy and unacceptably high offset.

SUMMARY

This disclosure provides materials and methods for improved inkjet printing. In embodiments, described is an inkjet printhead comprising a self-assembly monolayer (SAM) formed on at least a printing surface and an inside of a printing orifice of the inkjet printhead.

In embodiments, also described is a process for producing printed materials or printed electronics, comprising printing inks or electronics material inks onto a substrate using an inkjet printer with a printhead having the aforementioned surface coating.

In embodiments, also described is a method of forming an electronic device comprising printing a functional material ink on a substrate using a precision material deposition system, wherein the precision material deposition system comprises a printhead with a self-assembly monolayer (SAM) formed on at least a printing surface and an inside of a printing orifice of the inkjet printhead.

EMBODIMENTS

Figure 1:
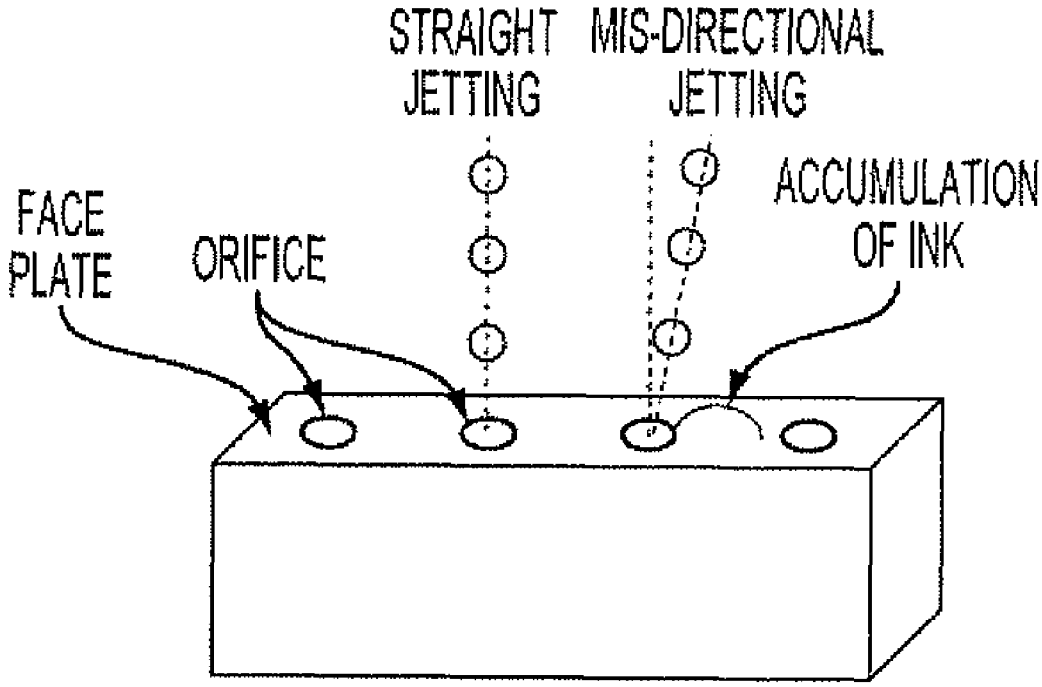
FIG. 1 represents a printhead having printing orifices and a printing face plate that are not modified. The accumulation of ink on the face plate of the printhead results in mis-directional jetting of the inkjet ink.

In embodiments, a printhead for inkjet printing includes a modification of the printhead to have a self-assemble monolayer (SAM) thereon, which prevents misdirectional jetting of the inkjet ink.

In embodiments, the inkjet printhead may be made from any effective material, such as silicon, metals, ceramics, plastics or combinations thereof.

In further embodiments, the printhead is a piezoelectric printhead. Exemplary printheads include the Spectra printhead, the Microfab printhead, the Xaar Printhead, the FujiFilm Dimatix piezoelectric printhead, the Xerox Solid ink printhead, the Epson printhead and the like. Differently from conventional printing, in embodiments the SAM modified printhead is used in high precision material deposition systems. Conventional printing, such as printing marks on paper, can tolerate an accuracy variability, or offset, between the original print pattern and the printed image of about 40 micrometers.

For printed electronic applications, an accuracy variability of below about 10 μm, such as below about 5 μm can be achieved. Such high accuracy is required for applications such as printed electronics applications. In embodiments, the printhead has a nozzle or printing orifice with a diameter of no greater than about 60 μm, such as less than about 45 μm, or less than about 30 μm. The drop size of an ink droplet jetted from the printhead is small, for example not greater than about 160 pL, such as less than about 50 pL, including less than about 35 pL or less than about 10 pL.

In embodiments, the misdirectional jetting of the inkjet ink may be addressed by using a SAM that provides the surface of the inkjet printhead (also referred to as the nozzle plate) with a uniform surface energy around a printing orifice and provides the printing surface of the printhead with a physically smooth or uniform surface (that is, by covering any bumps or filling any concavities). It is believed that unifying the surface energy or physical texture of the printing surface around the printing orifice prevents ink buildup around the printing orifice, thereby preventing jetted ink from being drawn to the surface of the printhead or to ink on the surface of the printhead by electrostatic forces, physical interactions such as surface tension, and the like.

It is believed that a uniform surface energy and physical surface smoothness can be achieved with a SAM surface layer because the SAM will evenly coat the printing surface of the printhead, covering any bumps or concavities in the printhead, and also presenting the same chemical groups across the printhead without substantial variation.

In embodiments, the self-assembly monolayer molecules comprise amphiphilic molecules comprised of either: a) a hydrophobic domain which spontaneously associates with the surface from a polar solvent, and a hydrophilic domain which allows the molecules to be dispersed in the polar solvent and which remains associated with the polar phase after monolayer formation on the surface, or b) a hydrophilic domain which spontaneously associates with the surface from a nonpolar solvent, and a hydrophobic domain which allows the molecules to be dispersed in a nonpolar solvent and which remains associated with the nonpolar phase after monolayer formation on the surface.

By "amphiphilic" it is meant that the molecules have two or more functional (and generally discrete) domains, defined herein as X and Y, respectively, each with corresponding and differing physical properties. Desirably, those properties are in the form of differing affinities for water, for example, water-soluble and water-insoluble groups. In turn, one or more first domains will have an increased affinity (for example, hydrophobic nature) for the surface or interface, while one or more second domains have an increased affinity (for example, hydrophilic nature) for the carrier solvent. The composition can be brought into sufficient proximity to a suitable surface or interface (for example, liquid-liquid, liquid-air or liquid-solid interface), to permit the molecules to spontaneously orient themselves into substantially monolayer form upon the surface of the printhead.

During and/or upon formation of the monolayer, latent reactive groups, which are provided by either the surface (or at the interface with another phase) and/or the SAM-forming molecules themselves, can be activated in order to covalently attach the thus-formed monolayer to the surface or interface. Embodiments, therefore, are not limited by the choice of SAM composition, or by the choice of surface/interface. Instead, a means that is generally applicable for attaching the monolayer to the corresponding inkjet printhead surface is provided.

In embodiments, the SAM is a hydrocarbon-containing layer formed from a precursor. The precursor comprises a material having the following formula: X—Y wherein X is a reactive group which can react with certain functional group (s) on the printhead surface, and Y is a hydrocarbon structure. In embodiments, X is selected from the groups consisting of —$PO_3H_3$, —$OPO_3H_3$, —COOH, —$SiCl_3$, —$SiCl(CH_3)_2$, —$SiCl_2CH_3$, —$Si(OCH_3)_3$, —$SiCl_3$, —$Si(OC_2H_5)_3$, —OH, —SH, —CONHOH, —NCO, benzotriazolyl(—$C_6H_4N_3$), and the like. The hydrocarbon structure in the hydrocarbon-containing layer may be a linear or branched hydrocarbon comprising the following exemplary number of carbon atoms: from 1 to about 60 carbon atoms, such as from about 3 to about 50 carbon atoms, from about 4 to about 40 carbon atoms, from about 5 to about 30 carbon atoms, and/or from about 10 to about 18 carbon atoms. In embodiments, the hydrocarbon structure is a linear or branched aliphatic or cyclic aliphatic group, a linear or branched group containing an aromatic group and/or aliphatic or cyclic aliphatic group, or an aromatic group. Reaction of the X group with the inkjet printhead surface will result in a heteroatom containing moiety in the substance, wherein the heteroatom containing moiety is covalently bonded to both the hydrocarbon structure and the inkjet printhead surface. Such a "heteroatom containing moiety" is not to be confused with the "heteroatom-containing group" of the "substituted hydrocarbon structure."

In embodiments, the precursor may be, for example, an alkylsilane, alkylphosphine, alkyl halo silane or a mixture thereof, where the alkyl moiety includes, for instance, from 1 to about 50 carbon atoms, from about 3 to about 50 carbon atoms, from about 4 to about 40 carbon atoms, from about 5 to about 30 carbon atoms, and/or from about 10 to about 18 carbon atoms. The halo in the alkyl halo silane may be chloro, fluoro, bromo and/or iodo.

In embodiments, the hydrocarbon structure may be a small molecule structure or a polymeric structure. The hydrocarbon structure could be a linear or branched structure. The hydrocarbon structure could be aliphatic, cyclic aliphatic, aromatic structure, or mixture thereof. The phrase "hydrocarbon structure" encompasses "substituted hydrocarbon structure" and "unsubstituted hydrocarbon structure." In embodiments, the phrase "substituted hydrocarbon structure" refers to replacement of one or more hydrogen atoms of the organic compound/organic moiety with Cl, Br, I and a heteroatom-containing group such as for example CN, $NO_2$, amino group ($NH_2$, NH), OH, COOH, alkoxyl group (O—$CH_3$), and the like, and mixtures thereof. In embodiments, the phrase "unsubstituted hydrocarbon structure" indicates that the structure is absent any replacement of a hydrogen atom of the organic compound/organic moiety with a substituent described herein.

In embodiments, the SAM is a fluorocarbon-containing layer formed from a precursor comprising SAM-forming molecules. The precursor comprises a material having the following formula: X—Y wherein X is a reactive group with can react with certain functional group(s) on the printhead surface, and Y is a fluorocarbon structure. In embodiments, X is selected from the groups consisting of —$PO_3H_3$, —$OPO_3H_3$, —COOH, —$SiCl_3$, —$SiCl(CH_3)_2$, —$SiCl_2CH_3$, —$Si(OCH_3)_3$, —$SiCl_3$, —$Si(OC_2H_5)_3$, —OH, —SH, —CONHOH, —NCO, benzotriazolyl(—$C_6H_4N_3$), and the like. The fluorocarbon structure in the fluorocarbon-containing layer may be a linear or branched fluorinated hydrocarbon comprising the following exemplary number of carbon atoms and fluorine atoms: 1 to about 60 carbon atoms, such as from about 3 to about 30 carbon atoms; and 1 to about 120 fluorine atoms, or from 2 to about 60 fluorine atoms. In embodiments, the fluorocarbon structure in the fluorocarbon-containing layer is a perfluorocarbon structure. In embodiments, the carbon atoms of the fluorocarbon structure in the fluorocarbon-containing layer are arranged in a chain of a length ranging for example from 3 to about 18 carbon atoms. In embodiments, the fluorocarbon structure may be a linear or branched aliphatic or cyclic aliphatic group, a linear or branched group containing an aromatic group and/or aliphatic or cyclic aliphatic group, or an aromatic group. Reaction of the X group with the inkjet printhead surface will result in a heteroatom containing moiety in the substance, wherein the heteroatom containing moiety is covalently bonded to both the fluorocarbon structure and the inkjet printhead surface. Such a "heteroatom containing moiety" is not to be confused with the "heteroatom-containing group" of the "substituted fluorocarbon structure."

In embodiments, the phrase "fluorocarbon structure" refers to an organic compound/organic moiety analogous to hydrocarbons in which one or more hydrogen atoms has been replaced by fluorine. The fluorocarbon structure can be a small molecule structure or a polymeric structure. The fluorocarbon structure may be a linear or branched structure. The fluorocarbon structure could be aliphatic, cyclic aliphatic, aromatic structure, or mixture thereof. The phrase "fluorocarbon structure" encompasses "substituted fluorocarbon structure" and "unsubstituted fluorocarbon structure;" In embodiments, the phrase "substituted fluorocarbon structure" refers to replacement of one or more hydrogen atoms of the fluorine-containing organic compound/organic moiety with Cl, Br, I and a heteroatom-containing group such as for example CN, $NO_2$, amino group ($NH_2$, NH), OH, COOH, alkoxyl group (O—$CH_3$), and the like, and mixtures thereof. In embodiments, the phrase "unsubstituted fluorocarbon structure" indicates that there is absent any replacement of a hydrogen atom of the fluorine-containing organic compound/organic moiety with a substituent described herein.

The precursor may be dispersed in a solvent before forming a layer on the substrate. Exemplary solvents include aliphatic hydrocarbon, aromatic hydrocarbon, alcohol, chlorinated solvent, ketone, ester, ether, amide, amine, sulfone, sulfoxide, carboxylic acid, tetrahydrofuran, heptane, octane, cyclohexane, toluene, xylene, mesitylene, dichloromethane, dichloroethane, chlorobenzene, dichlorobenzene, nitrobenzene, propanols, butanols, pentanols, dimethylsulfoxide, dimethylformamide, alkanecarboxylic acids, arenecarboxylic acids, and mixtures thereof.

The carrier solvent (in which the SAM-forming molecules are initially provided) and the surface to which the carrier solvent is applied will themselves typically have different affinities for water, corresponding to the respective domains of the SAM-forming molecules. In turn, when a composition of SAM-forming molecules in carrier solvent is brought into physical proximity with the surface, or interface, the molecule domains spontaneously and preferentially orient themselves toward either the solvent or surface/interface, in order to form a monolayer. The carrier solvent, in turn, is ideally one in which the second domain of the SAM-forming molecule has preferential solubility or affinity, and which itself is not a solvent for the surface.

The SAM precursor may be present in the solvent in a content of from about 1 wt % to about 95 wt %, such as from about 5 wt % to about 90 wt %, from 10 to about 80 wt %, or from about 25 wt % to about 75 wt %, by total weight of the precursor and solvent.

The SAM precursor will be linked (usually covalently) to the substrate through the reactive group X discussed above.

The inkjet printhead surface may directly link with the reactive group X, or may react with X through a reactive coating on the inkjet ptinthead surface, the reactive coating including metals such as gold, mercury, ITO (indium-tin-oxide), siloxane and the like. The inkjet printhead surface may have a planar surface, including compounds such as silicon, metals, plastics and the like, or curved surfaces, including compounds such as nanoparticles and the like.

In embodiments, the SAM may be formed from a trichlorosilane, or a trichlorododecylsilane, monolayer. In embodiments, the SAM may be formed from a fluorotrichlorosilane, or a fluorotrichlorododecylsilane, monolayer. In embodiments, the SAM may be a siloxane monolayer.

In embodiments, the SAM is a single layer. In other embodiments, there is present a plurality of two or more SAM layers. In embodiments, the layer material is a polymer (having a degree of polymerization "n" of about 2 or more such, as for example, from about 2 to about 100).

A single SAM layer typically has a thickness of less than about 5 nanometers, such as less than about 2 nanometers. In embodiments, the layer is a crosslinked layer, such as through siloxane bonds formed between adjacent silicon groups of the monolayer constituents. In embodiments, the layer material is covalently bonded to the printhead. In other embodiments, the layer material is not covalently bonded to the printhead.

Also disclosed is a method for forming a self-assembly monolayer on a printhead surface, the method comprising the steps of: a) providing on the surface both latent reactive groups and a monolayer formed of self-assembling monolayer molecules, and b) activating the latent reactive groups under conditions suitable to either covalently attach the self-assembled monolayer to the surface and/or to form a stable monolayer film on the surface, for example by initiating polymerization of suitable groups provided by self-assembling monolayer molecules themselves and/or by forming intermolecular bonds between the self-assembling monolayer molecules.

The SAM layer may be deposited on the printhead substrate by any known or effective technique, such as formation of a SAM layer from a precursor in solution or using physical vapor deposition, electrodeposition, electroless deposition, and the like.

Physical vapor deposition techniques include evaporative deposition, in which the material to be deposited is heated to a high vapor pressure by electrically resistive heating in low vacuum; electron beam physical vapor deposition, in which the material to be deposited is heated to a high vapor pressure by electron bombardment in high vacuum; sputter deposition, in which a glow plasma discharge bombards the material, thereby sputtering some away as a vapor; cathodic arc deposition, in which a high power arc directed at the target material blasts away some into a vapor; pulsed laser deposition, in which a high power laser ablates material from the target into a vapor; and the like.

The process for modifying an inkjet printhead may include, for example, immersing the printhead in a SAM precursor solution in toluene to grow a SAM layer on the printhead. After immersion, the printhead may be rinsed with toluene.

The concentration of the SAM precursor solution (concentration of the SAM-forming material in solution) may be from about 0.001 M to about 1 M, such as from about 0.01 M to about 0.2 M. In embodiments, the concentration of the SAM precursor solution may be about 0.1 M. The printhead may be immersed in the SAM precursor solution from about 1 min to about 1 hour, including from about 5 min to about 30 min at a suitable temperature such as from about room temperature (such as from about 20° C. to about 25° C.) to 100° C., including from room temperature to about 60° C. In embodiments, the printhead is modified using a SAM precursor solution concentration of about 0.1 M at 60° C. for 20min.

SAMs can be prepared using various methods, such as the Langmuir Blodgett technique, which involves the transfer of a film pre-assembled at an air water interface to a solid substrate. SAMs can also be prepared by a self-assembly process that occurs spontaneously upon immersion of the inkjet printhead into a solution containing an appropriate amphiphile or a solution of solvent and amphiphilic compound precursors.

The process for modifying an inkjet printhead may also include an initial preparation step such as cleaning the printhead in an acid bath or using a plasma cleaning method to clean the printhead before applying the SAM to the printing surface of the printhead.

In embodiments, the SAM layer is applied to the printing plate surface of the inkjet printhead, around the printing orifice of the inkjet printhead, or over the entirety of the inkjet printhead, including inside the printing orifice. Particularly beneficial inkjet accuracy and detailed droplet control may be achieved when the SAM layer is applied over the entirety of the inkjet printhead, including inside the printing orifice, for printing of electronic materials inks.

Prior to SAM modification, the surface of printhead has a variable surface energy which can be measured using advancing water contact angle measurement techniques. Prior to modification, the surface of the printhead has a high surface energy with a water contact angle as measured at room temperature of from about 20 degrees to about 80 degrees, such as from about 30 degrees to about 75 degrees. Moreover, if positions are measured on a printhead surface that has not been SAM modified, the variation of water contact angles between measurement positions on the printhead surface is large, such as larger than about 8 degrees, larger than about 15 degrees, or larger than about 20 degrees. After modification of the printhead with a SAM layer, the surface of the printhead has a low surface energy, exhibiting a water contact angle of from about 90 degrees to about 120 degrees, such as from about 95 degrees to about 105 degrees. Additionally, the surface energy of the printhead printing surface is substantially uniform. For example, the variation of water contact angle between two or more measurement positions on the SAM modified printhead is less than about 8 degrees, such as less than about 5 degrees or less than about 3 degrees, from position to position on the printhead surface.

The surface-modified inkjet printhead may be used to print any type of inkjet ink or jettable composition onto any appropriate substrate such as glass, polyethylene terephtalate (PET), PEN, polyimide, and the like, utilizing application techniques such as drop-on-demand inkjet printing or intermediate printing. Products produced using the disclosed printhead can include, but are not limited to, electronic devices, photovoltaic devices, organic light emitting diode (OLED) devices, thin film transistors (TFT), microfluid devices, and the like.

Also disclosed is a process for producing printed electronics comprising the step of printing an electronic material in the form of an inkjet ink or jettable composition onto a substrate using an inkjet printhead modified to include a surface layer, such as a SAM, on the printing surface of an inkjet printhead.

The printed electronic materials may be semiconductor materials including organic semiconductor materials, conductor materials such as silver nanoparticle inks, insulating materials, and the like.

The printed electronics material ink may be an ink composed of electronic materials in a solvent. Exemplary electronic materials include polythiophene, oligothiophene, pentacene precursors or thiophene-arylene copolymer. In embodiments, the electronic material comprises poly(3,3'''-didodecylquarterthiophene) (PQT) nanoparticles. Exemplary solvents include aliphatic hydrocarbon, aromatic hydrocarbon, alcohol, chlorinated solvent, ketone, ester, ether, amide, amine, sulfone, sulfoxide, carboxylic acid, tetrahydrofuran, heptane, octane, cyclohexane, toluene, xylene, mesitylene, dichloromethane, dichloroethane, chlorobenzene, dichlorobenzene, nitrobenzene, propanols, butanols, pentanols, dimethylsulfoxide, dimethylformamide, alkanecarboxylic acids, arenecarboxylic acids, heir derivatives, or mixtures thereof. The solvent may be a 1,2-dichlorobenzene.

In further embodiments, the electronic material has a low surface tension such as less than about 35 mN/m, less than about 30 mN/m, or less than about 26 mN/m. In embodiments, the electronic material is a Newtonian fluid. In embodiments, the electronic material is a non-Newtonian fluid such as a fluid having a gel structure or a fluid comprising nanoparticles. The electronic material may have a viscosity less than about 10 cps, or less than about 5 cps at a high shear rate such as $1000s^{-1}$. In embodiments, the SAM modified printhead is used for printing of non-Newtonian fluids with low surface tensions and low viscosities, or non-Newtonian fluids having a gel structure or comprising nanoparticles.

FIG. 1 shows an inkjet printhead having printing orifices and a printing plate that are not modified. Ink is shown accumulated around a printing orifice, thereby causing misdirectional jetting of later jetted ink. When the ink is not present around the printing orifice, misdirected jetting of ink is not observed.

Figure 2:
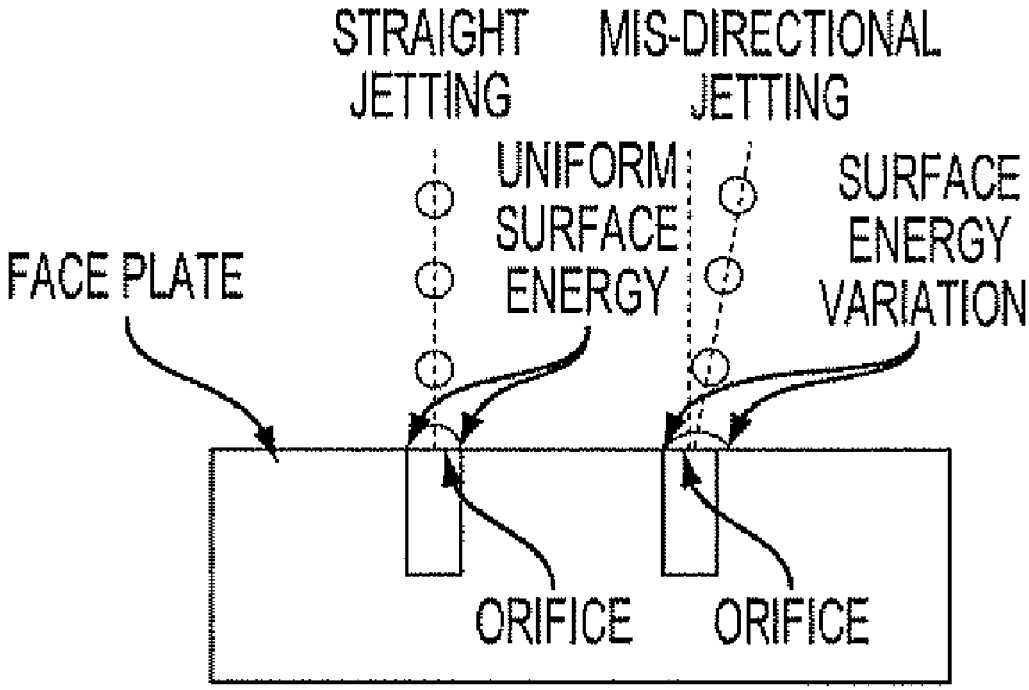
FIG. 2 represents an alternate view of the printhead of FIG. 1.

FIG. 2 shows an inkjet printhead having printing orifices and a printing plate that are not modified. Variations in surface energy of the printing surface of the printhead, particularly surface energy variations around a printing orifice are another source of misdirectional jetting of ink droplets. When the surface energy is uniform around the printing orifice of the printhead, the ink droplets are not drawn or pushed from their intended delivery path, and thereby create a more controlled and accurate deposition on the desired substrate.

Figure 3:
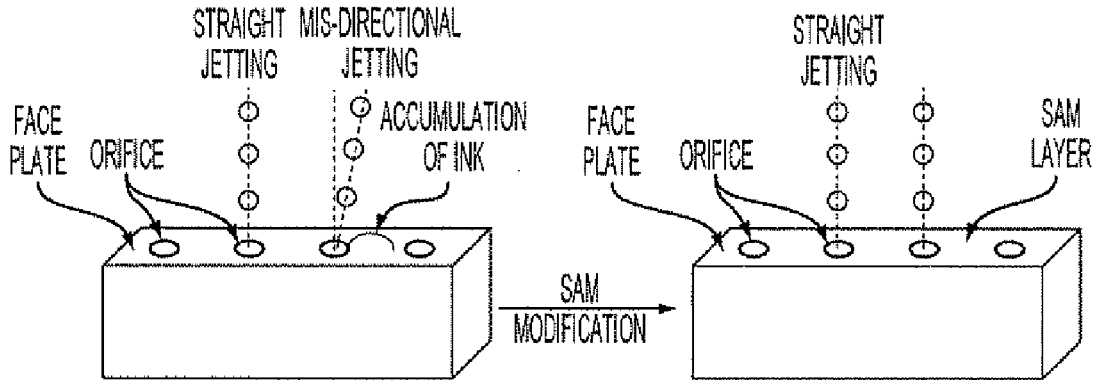
FIG. 3 represents a printhead before and after modification with a SAM on the face plate of the printhead to prevent mis-directional jetting of the inkjet ink.

FIG. 3 shows that incorporation of a SAM layer onto inkjet printhead can reduce accumulation of ink around the printing orifice, and thereby decrease undesirable misdirectional jetting of ink.

Figure 4:
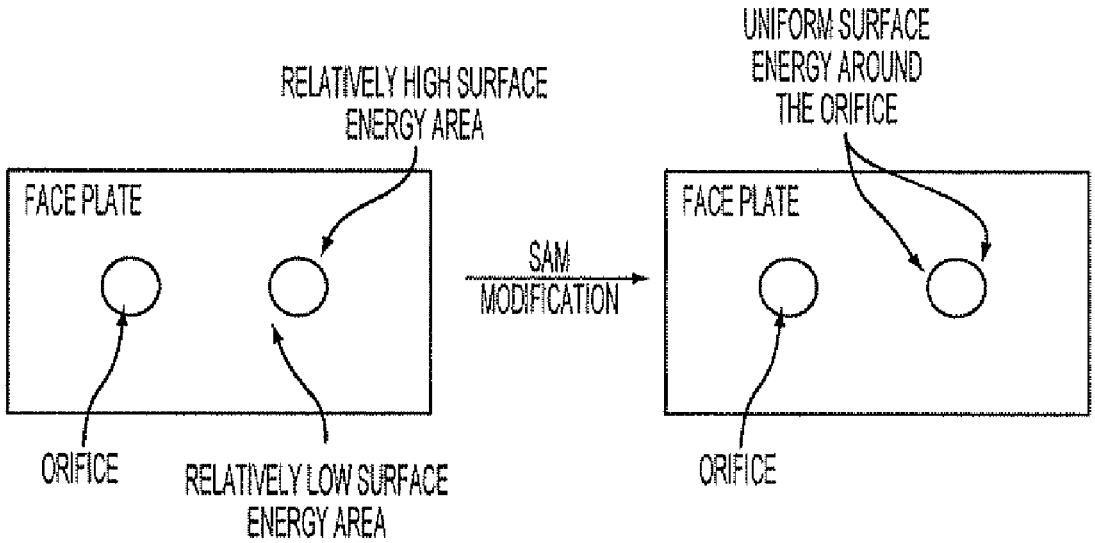
FIG. 4 represents the difference in surface area energy between unmodified and SAM modified printheads.

FIG. 4 shows that incorporation of a SAM layer onto an inkjet printhead can reduce variation in surface energy of the printhead around the printing orifice, and reduce misdirectional jetting of ink in this manner as well.

Figure 5:
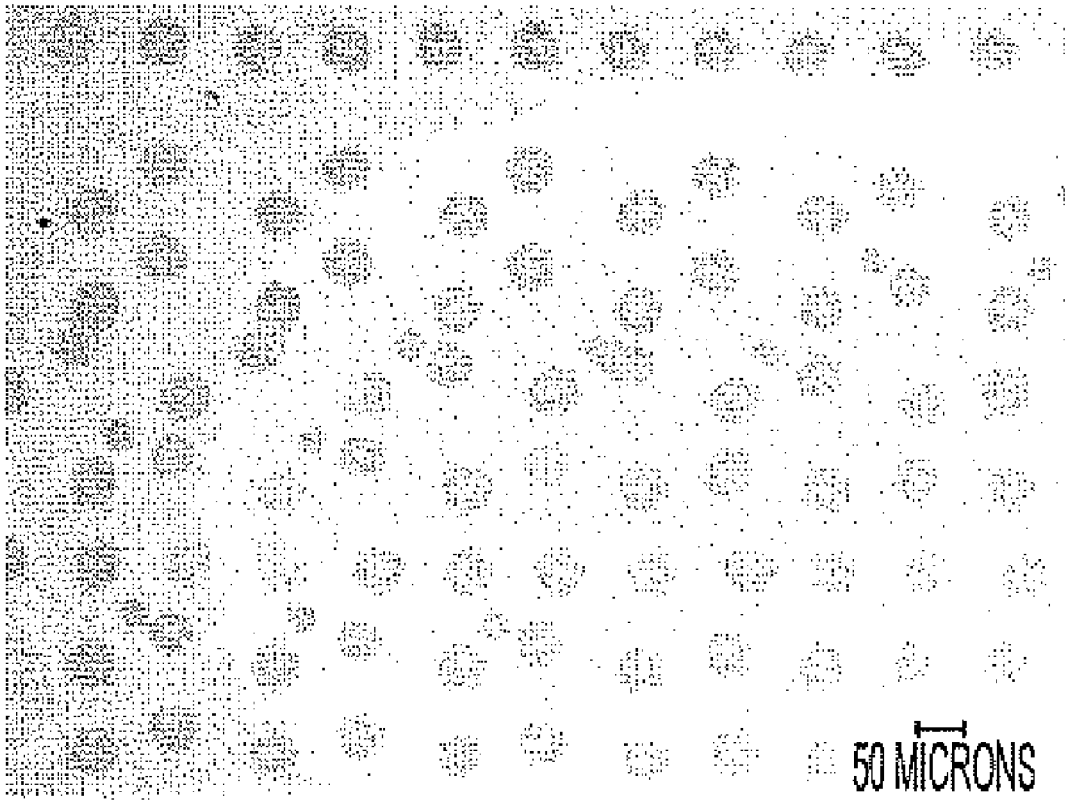
FIG. 5 is an image of a 4×4 cm printed dots array with 100 μm spacing printed with an inkjet printhead that is not modified.

FIG. 5 is an image of the results of the Comparative Example, a 4×4 cm dots array printed with 100 μm spacing, printed using a standard (no SAM layer modification) inkjet printhead to evaluate printing accuracy. As can be seen, a large percentage of printed dots were not printed accurately, showing the results of misdirectional printing.

Figure 6:
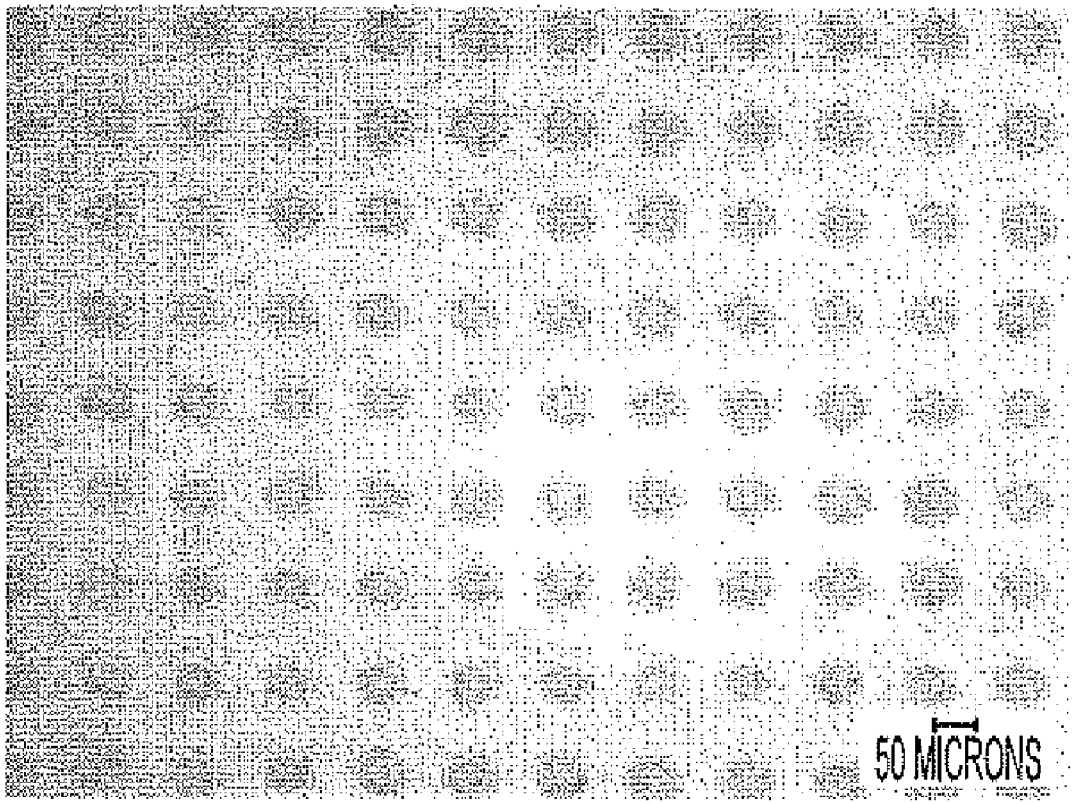
FIG. 6 is an image of a 4×4 cm printed dots array with 100 μm spacing printed using an inkjet printhead modified with a SAM.
Figure 7A:
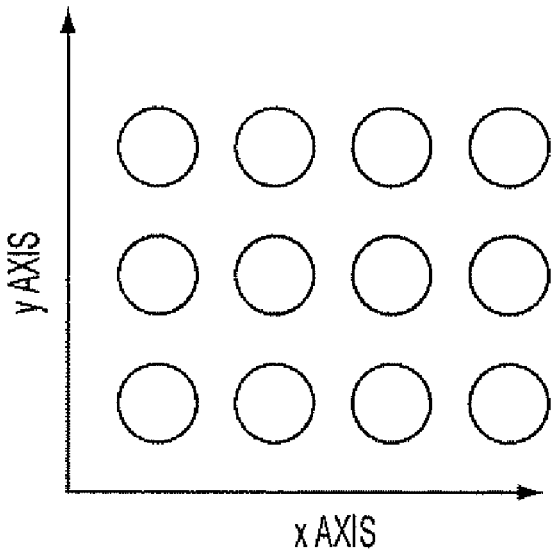
FIGS. 7A and 7B illustrate deviation of a printed dots array from an original pattern design, the extent of the deviation being measured as offset.
Figure 7B:
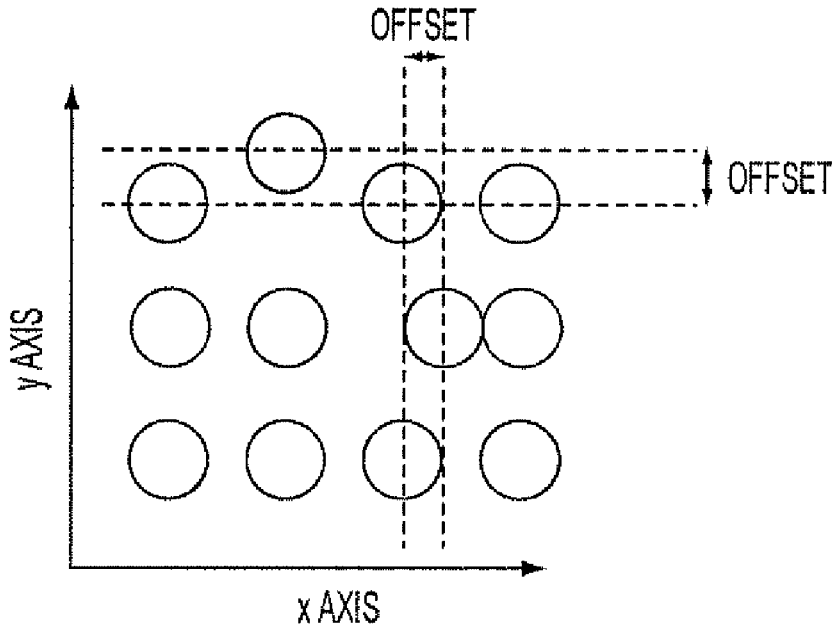

FIG. 6 is an image of the results of the Example. FIG. 6 is an image of another 4×4 cam dots array printed with 100 μm spacing, printed with an inkjet printhead modified with a SAM layer. It is clearly evident that significantly improved accuracy was achieved using the SAM-modified inkjet printhead as compared to the non-modified inkjet printhead of the Comparative Example. An offset value is used to illustrate the printing accuracy. The drop offset is the distance differentiation between the printed image and the original image design. As shown in FIGS. 7A and 7B, printed dots may deviate from the original image design. The difference (offset) between the printed image and the original image design can be measured. In embodiments, the offset is less than about 30 um, such as less than about 20 um, or less than about 10 um, in both the x and y directions.

The following examples were prepared to further illustrate embodiments described herein.

COMPARATIVE EXAMPLE

An ink composed of PQT nanoparticles in 1,2-dichlorobenzene was printed using a Dimatix inkjet printer equipped with a 10 pL cartridge to deposit the ink on a substrate in a 4×4 cm dots array with 100 μm spacing to ascertain printing accuracy. The results of the printing test are shown in FIG. 5. Most rows showed misdirectional deposition of the ink on the substrate.

EXAMPLE

Prior to printing a dots array as in the comparative example, the printhead was first immersed in a 0.1 M trichlorododecylsilane solution in toluene at room temperature for 30 minutes to grow a SAM on the surface of the printhead face plate. After modification, the printhead was rinsed with toluene thoroughly and dried. The same 4×4 cm dots array as in the comparative example was printed. The results of the printing test may be seen in FIG. 6. No misfiring drops were observed in the printed dots array.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An inkjet printhead comprising a self-assembly monolayer (SAM) formed on at least a printing surface and an inside of a printing orifice of the inkjet printhead, wherein an advancing water contact angle variation at room temperature between any two locations on the printing surface of the printhead is less than 5 degrees.

2. The inkjet printhead of claim 1, wherein the SAM is directly bonded to the printing surface of the inkjet printhead.

3. The inkjet printhead of claim 1, wherein the SAM is a crosslinked SAM.

4. The inkjet printhead of claim 1, wherein the printhead has a substantially uniform surface energy around a printing orifice.

5. The inkjet printhead of claim 1, wherein the SAM is covalently bonded to the printing surface of the inkjet printhead.

6. The inkjet printhead of claim 1, wherein the SAM is bonded to a reactive coating on the inkjet printhead.

7. The inkjet printhead of claim 1, wherein the SAM is formed from an alkyl silane.

8. The inkjet printhead of claim 7, wherein the SAM is formed from trichlorododecylsilane.

9. The inkjet printhead of claim 1, wherein the printhead has a printing orifice size of less than 60 μm in diameter and prints a drop size of less than 50 pL.

10. A method of forming an image comprising printing an ink on a substrate with an inkjet printer, wherein the inkjet printer comprises a printhead with a self-assembly monolayer (SAM) formed on at least a printing surface and an inside of a printing orifice of the inkjet printhead, wherein an advancing water contact angle variation at room temperature between any two locations on the printing surface of the printhead is less than 5 degrees.

11. The method of claim 10, wherein the printhead has a printing orifice size of less than 60 μm in diameter and prints a drop size of less than 50 pL.

12. The method of claim 10, wherein the drop offset of the image is less than 20 micrometers.

13. The method of claim 10, wherein the SAM is directly bonded to the printing surface of the inkjet printhead.

14. A method of forming an electronic device comprising printing a functional material ink on a substrate using a precision material deposition system, wherein the precision material deposition system comprises a printhead with a self-assembly monolayer (SAM) formed on at least a printing surface and an inside of a printing orifice of the inkjet printhead, wherein an advancing water contact angle variation at room temperature between any two locations on the printing surface of the printhead is less than 5 degrees.

15. The method of claim 14, wherein the functional material ink comprises one or more members of the group consisting of semiconductor, conductor or insulator materials.

16. The method of claim 14, wherein the functional material ink further comprises an organic solvent.

17. The method of claim 14, wherein the functional material ink is a non-Newtonian fluid with a surface tension of less than 35 mN/m.

18. An inkjet printhead comprising a self-assembly monolayer (SAM) formed on at least a printing surface and an inside of a printing orifice of the inkjet printhead, wherein an advancing water contact angle variation at room temperature between any two locations on the printing surface of the printhead is less than about 5 degrees, and wherein the SAM is derived from a precursor X—Y, wherein X is a reactive group selected from the group consisting of $—PO_3H_3$, $—OPO_3H_3$, —COOH, $—SiCl_3$, $—SiCl(CH_3)_2$, $—SiCl_2CH_3$, $—Si(OCH_3)_3$, $—SiCl_3$, $—Si(OC_2H_5)_3$, —OH, —CONHOH, —NCO and $—C_6H_4N_3$, and Y is a hydrocarbon structure or a fluorocarbon structure.

* * * * *